United States Patent [19]

Miller et al.

[11] 3,986,382

[45] Oct. 19, 1976

[54] HORIZONTAL CAN IRONING PRESS

[75] Inventors: Stanley J. Miller, Hastings; Richard J. Heniser, Grand Rapids, both of Mich.

[73] Assignee: Gulf & Western Manufacturing Company (Hastings), Southfield, Mich.

[22] Filed: June 9, 1975

[21] Appl. No.: 584,940

[52] U.S. Cl. ..... 72/347; 72/349

[51] Int. Cl.[2] ..... B21D 22/20; B21D 22/28

[58] Field of Search ..... 72/343, 347, 348, 349, 72/350, 351, 354, 361

[56] References Cited

UNITED STATES PATENTS

| | | | |
|---|---|---|---|
| 2,800,813 | 7/1957 | Fischer | 72/347 |
| 3,270,544 | 9/1966 | Maeder et al. | 72/348 |
| 3,289,453 | 12/1966 | Wyle | 72/349 |
| 3,704,619 | 12/1972 | Paramonoff | 72/349 |
| 3,793,871 | 2/1974 | Kinghorn | 72/349 |

*Primary Examiner*—C.W. Lanham
*Assistant Examiner*—E. M. Combs
*Attorney, Agent, or Firm*—Meyer, Tilberry & Body

[57] ABSTRACT

An improved arrangement is provided for relatively reciprocating the ram and blank holder components of a horizontal can blank forming machine. The machine includes a reciprocable slide carrying the ram, and a reciprocable blank holder frame on which the blank holder is mounted. The slide and blank holder frame are driven by a common crankshaft through corresponding crank arms angularly related circumferentially of the crankshaft axis to impart the desired motion characteristics to the slide and blank holder frame upon rotation of the crankshaft. The blank holder frame includes a vertical plate member defining the driven end of the blank holder frame, and horizontal rods interconnect the vertical plate with a frame plate at the opposite end of the blank holder frame and on which the blank holder is mounted. The axes of the crankshaft, blank holder, blank holder frame rods and ram are coplanar with one another and with the axes between the crank arms and the blank holder frame and slide.

26 Claims, 10 Drawing Figures

HORIZONTAL CAN IRONING PRESS

This invention relates to the art of can making and, more particularly, to an improved arrangement for relatively reciprocating the ram and blank holder components of a press for making seamless can bodies.

The present invention is particularly suited for making seamless can bodies from metal, such as aluminum or steel, and will be described with particular reference thereto. It will be appreciated, however, that the invention is capable of broader application and could be used for making other seamless cup-shaped articles.

As is well known, seamless metal can bodies are often produced by deep drawing a circular metal blank into a cup-shaped member which is subsequently redrawn and ironed to elongate and thin the sidewall of the blank to desired dimensions. A variety of machines have been designed for achieving such redrawing and ironing of a cup-shaped blank. Often, such machines include a frame supporting at least one ram or punch for horizontal movement along a linear path between first and second ram positions, and a tubular blank holder member coaxial with the ram and supported by the machine frame for movement relative to the ram and between first and second blank holder positions. The ram is received in the blank holder for movement therethrough, and a redraw die ring and one or more ironing rings are supported by the machine frame in the path of movement of the punch and blank holder member.

In operation of such a machine, a cup-shaped blank is fed onto a support adjacent the redraw die ring with the open side of the blank facing the ram and blank holder member, and the blank holder is advanced toward and enters the open end of the blank to position and hold the blank against the redraw die ring. Thereafter, the ram advances through the blank holder to engage and move the blank through the redraw and ironing rings to achieve the desired forming of the blanks. Such machines may further include a doming assembly aligned with the ram and supported by the machine frame for engagement by the ram and a can blank thereon when the ram has passed through the ironing rings. The latter operation corresponds with the second position of the ram, and following such doming the ram is returned to its first position in which the ram is withdrawn relative to the blank holder and redraw die ring. During such movement, the can blank is stripped from the ram, and the formed can is removed from the machine.

As mentioned above, the purpose of the blank holder member is to initially engage and position the cup-shaped blank relative to the redraw die ring. Accordingly, the blank holder is axially reciprocable between a first position which permits a cup-shaped blank to be fed between the redraw die ring and holder, and a second position in which the blank is positioned and held in place with respect to the redraw die ring. Such axial reciprocation of the blank holder member requires considerably less axial movement of the blank holder than is required for the ram to achieve the subsequent redrawing and ironing of the blank. In this respect, for example, linear displacement of the ram between its first and second positions may be four to five times greater than the linear displacement of the blank holder between its corresponding positions. Further, timing of the displacement of the blank holder to position the blank relative to the redraw die, and movement of the ram through the blank holder to displace the blank through the redraw die, are important considerations in connection with achieving proper positioning of the blank prior to displacement thereof by the ram through the redraw die. More particularly, the success and accuracy of the redrawing operation is dependent on accurately positioning and adequately holding the cup-shaped article in positional relationship with respect to the redraw die ring and the blank holder. Moreover, under modern mass production conditions, high production rates are desired and this requires high speed operation of the ram and blank holder members. Such high speed operation further adds to the importance of achieving proper timing and consistent positional relationship between the ram and blank holder members during movement thereof to achieve blank positioning and redrawing. In the absence of a desired degree of accuracy, excessive metal-to-metal impacts can occur between the blank and the blank holder and/or ram which can damage the blank as well as the machine components. This is especially true in the forming of metallic can bodies which are of relatively thin metal construction.

In addition to achieving consistency in timing and relative positioning of the ram and blank holder during succeeding strokes thereof, it is most desirable to minimize or eliminate vibration and/or side thrusts in connection with stroke displacement of the ram and blank holder members. Such vibration and side thrust cause wear to the various machine elements, and can cause damage to the cup-shaped blank and/or improper placement and positional retainment thereof at the initiation of the redraw operation. Such possibilities can result in damaged and/or improperly redrawn and ironed can blanks.

Machines heretofore employed in connection with the redrawing and ironing of cup-shaped can blanks have not provided the desired degree of accuracy and consistency in timing between ram and blank holder movements in a high speed can forming machine, nor have they provided the desired degree of stability against vibration and/or side thrusts. Generally, the ram is reciprocated through a mechanical drive arrangement which may include a crank and a crank arm connecting the crank and a slide member on which the ram is mounted. This provides consistent displacement of the ram during each stroke of the crank. However, difficulty is encountered in connection with efforts to achieve consistency with respect to the desired relative strokes of the ram and blank holder. Additionally, difficulty is encountered in connection with efforts to achieve the desired positional and timing relationships between the ram and blank holder during the critical phase of engagement of the blank holder with the blank and redraw die and movement of the ram to displace the blank through the die. In this respect, for example, U.S. Pat. No. 3,704,619 discloses an arrangement in which a pivotal, cam driven follower arm is attached to a blank holder support frame and is pivoted by a rotating cam to impart reciprocating movement to the blank holder frame and thus the blank holder. The cam is contoured to provide the desired blank holder stroke, and the follower arm is biased against the cam during operation of the machine. Arrangements such as that shown in the foregoing patent are structurally complex and involve a substantial number of interenaging movable parts subject to considerable wear and vibration during machine operation, especially at high production speeds. Moreover, accuracy and consistency with regard to timing, positional relationships and the blank holder stroke are difficult if at all possible to achieve due to vibration, cam and follower separation, and wear between the component parts.

In accordance with the present invention, an improved arrangement is provided for mechanically driving the blank holder and by which consistency of the blank holder stroke is assured together with minimum vibration, reduced part wear and structural simplicity. More particularly in accordance with the present invention, the blank holder is mounted on a frame which is supported by the main frame on the machine for reciprocating movement through a corresponding blank holder stroke. Reciprocation is imparted to the blank holder frame through a crank arrangement which preferably is common with the machine crankshaft by which the ram is reciprocated through its stroke. The drive crank arrangement provides uniformity in the length of the stroke of the blank holder and assures continuity in the position and motion characteristics of the blank holder as it moves toward the redraw die to engage and position a blank relative thereto during each stroke. Moreover, the crank driven arrangement minimizes the structural components necessary to achieve blank holder displacement relative to the machine frame and avoids any relative displacement between the drive components and blank holder frame.

In accordance with another aspect of the present invention, a blank holder frame structure is provided which advantageously enables the blank holder to be reciprocated in the foregoing manner together with reciprocation of a slide member on which the ram is mounted. More particularly, the blank holder frame includes a plate member adjacent the drive shaft of the machine, and a crank arrangement on the drive shaft is connected with the plate member to reciprocate the latter. Further, a second crank arrangement is associated with the drive shaft to impart reciprocating movement to the slide member. Each crank arrangement provides the desired stroke displacement for the corresponding one of the blank holder frame and slide, and provides for consistency with respect to the relative strokes and motion characteristics thereof during each stroke. In the preferred arrangement, the blank holder frame plate member is slidably mounted on pins provided on the main frame so as to transmit side thrusts imposed on the plate member to the main frame and thus minimize the effect of any such thrusts on the blank holder member which is mounted on the frame forwardly of the plate member. Thus, a positive drive arrangement is provided for both the blank holder and ram by which accuracy and consistency of the relative stroke lengths is achieved simultaneously with accuracy and consistency with respect to the relative positional relationships between the ram and blank holder during each stroke thereof. Additionally, wear and vibration are minimized, and operation efficiency of the machine is increased. These characteristics advantageously enable high speed production with reduced blank material damage or loss in comparison with machines provided heretofore.

It is accordingly an outstanding object of the present invention to provide a can blank forming press having improved operating characteristics with regard to the blank holder and ram components thereof.

Another object is the provision of an improved drive arrangement for the blank holder member of a can blank forming press.

Still another object is the provision of a can blank forming press having reciprocable ram and blank holder members, the strokes and relative positional relationships of which are more accurate and consistent during succeeding cycles of operation of the machine than heretofore possible.

Yet a further object of the invention is the provision of a can blank forming press in which the ram and blank holder members are positively driven through a common drive shaft by corresponding crank arrangements associated with the drive shaft.

Still another object of the invention is the provision of a can blank forming press having an improved blank holder frame structure by which reciprocation of the ram and blank holder is achieved in the foregoing manner.

Still a further object is the provision of a can blank forming press of the foregoing character in which the blank holder frame is supportably interengaged with the main frame of the press to achieve transmittal of side thrusts on the blank holder frame to the main frame.

Still another object is the provision of a can blank forming press having an improved drive arrangement for the ram and blank holder components which is structurally simple, economical to produce and maintain, and which provides accuracy and consistency with respect to the relative strokes, timing and positional relationships between the ram and blank holder during press operation.

The foregoing objects, and others, will in part be obvious and in part be pointed out more fully hereinafter in conjunction with the written description of a preferred embodiment of the invention illustrated in the accompanying drawings in which.

Figure 1:
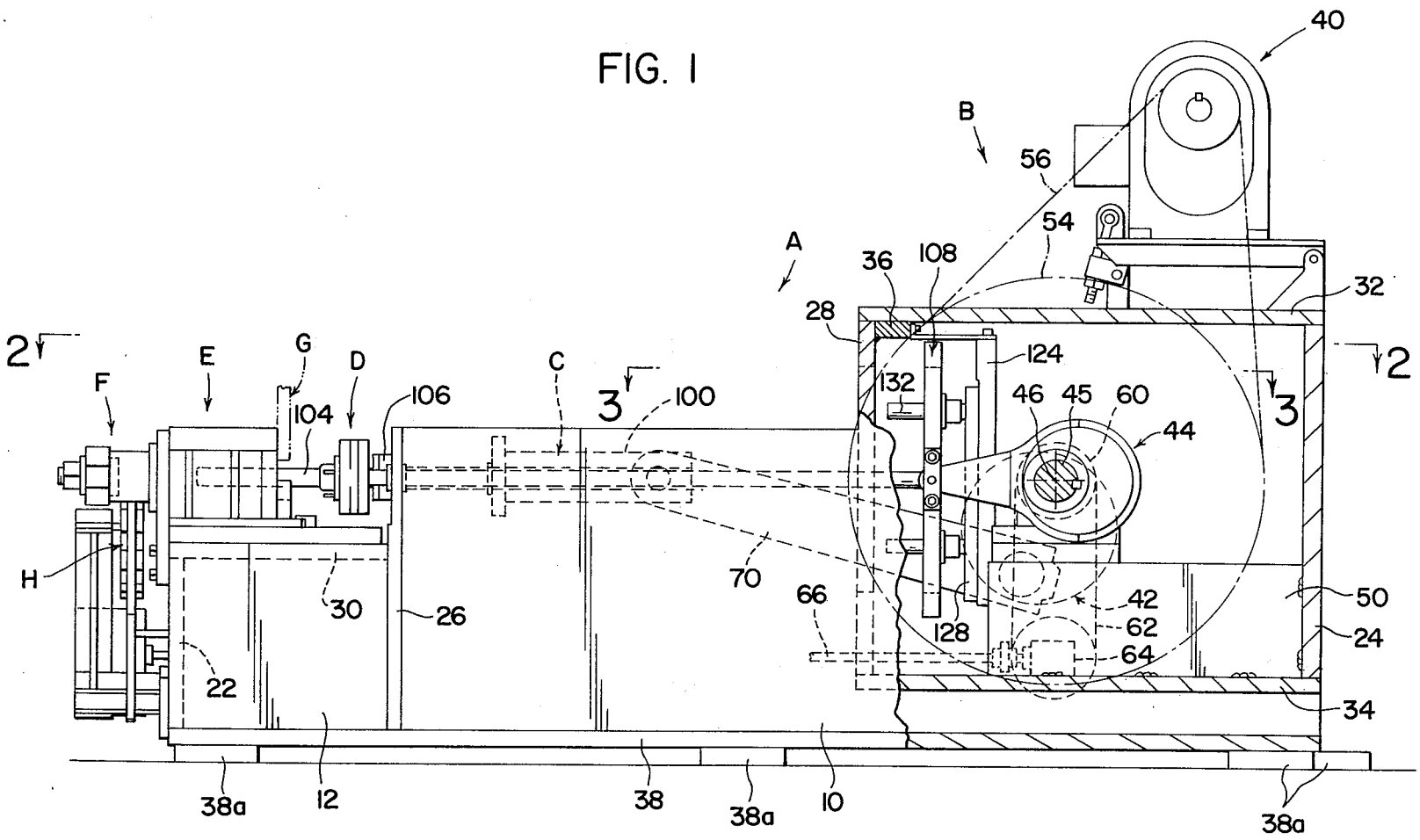
FIG. 1 is a side elevation view, partially in section, of a can blank forming press constructed in accordance with the present invention.
Figure 2:
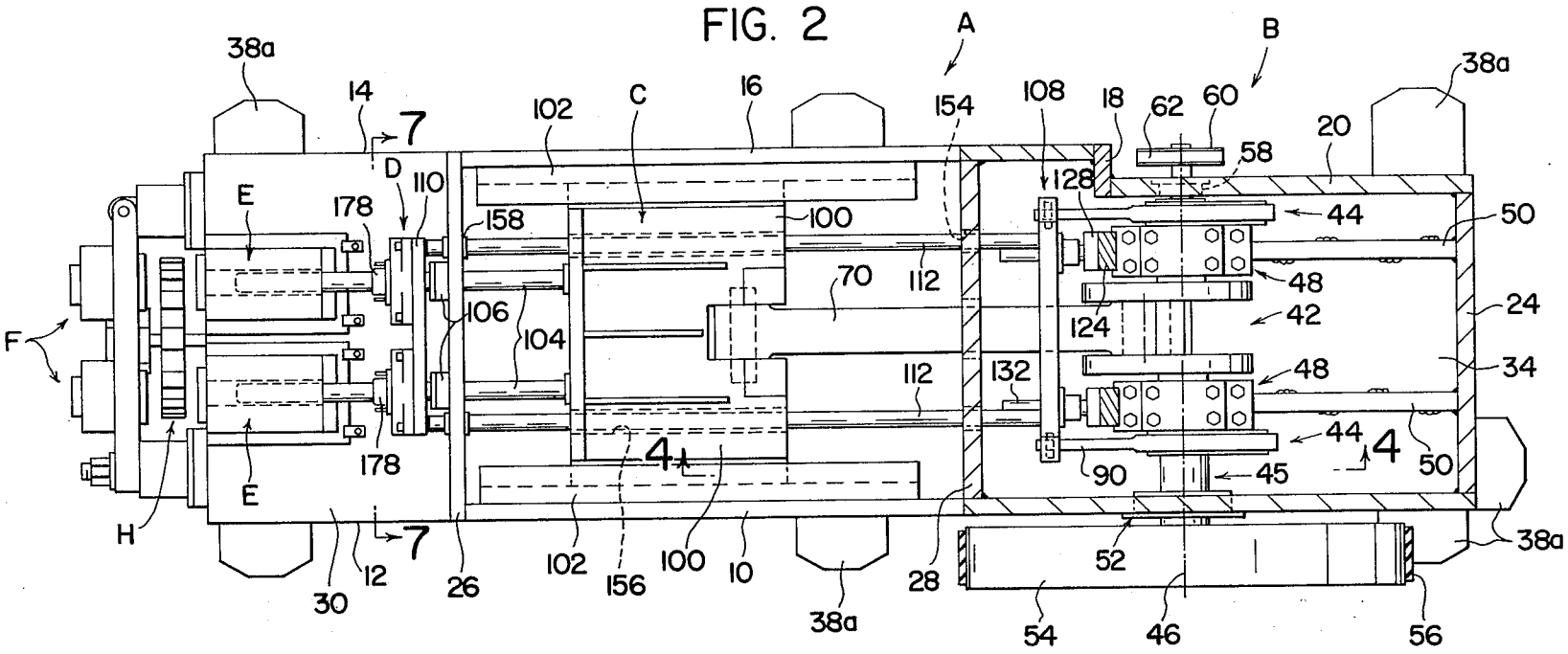
FIG. 2 is a plan view of the press, partially in section, taken along line 2—2 in FIG. 1.

Referring now in greater detail to the drawings wherein the showings are for the purpose of illustrating a preferred embodiment of the invention only and not for the purpose of limiting the invention, FIGS. 1 and 2 show the overall arrangement of a can blank forming press. The press includes a horizontally extending main frame A which supports a drive assembly B for reciprocating a punch and slide assembly C and a blank holder and blank holder frame assembly D in working relationship with redraw and ironing ring assemblies E and doming assemblies F. Cup-shaped metal can blanks are sequentially delivered form a feed assembly G to a location adjacent the entrance end of redraw and ironing assemblies E. The blanks are fed in timed relationship with the reciprocation of assemblies C and D, and the redraw and ironing ring assemblies E and the corresponding doming assemblies F function respectively to elongate the sidewalls of the can blanks and dome-in the bottom walls thereof to form a can body. The formed can bodies are discharged from the machine by a discharge assembly H positioned beneath the path of movement of the can blanks and between redraw and ironing ring assemblies E and doming assemblies F.

FRAME A

As shown in FIGS. 1 and 2, frame A is comprised of upright wall members 10 and 12 defining one side, and upright wall members 14, 16, 18 and 20 defining the other side. The frame further includes a cross plate 22 at one end thereof, a cross plate 24 at the other end thereof, and cross plates 26 and 28 intermediate the opposite ends of the frame. A horizontal frame plate 30 extends across and is disposed atop side plates 12 and 14, and horizontal frame plates 32 and 34 extend respectively between the upper and lower edges of cross plates 24 and 28. Further, a horizontal plate member 36 extends across the frame between the upper edges of sidewall members 10 and 16 and adjacent cross plate 28 for the purpose set forth hereinafter. The several wall and plate members are welded or otherwise interconnected to provide a rigid frame unit and are likewise welded or otherwise suitably interconnected with a base plate 38 having mounting strips 38a extending therebeneath and across the frame.

DRIVE ASSEMBLY B

The drive assembly includes a fixed speed, geared motor 40 and a crank assembly including crank members 42 and 44 having a common crankshaft 45 supported for rotation about a crank axis 46 by a pair of bearing block assemblies 48 mounted within the main frame on support plates 50. One end of crankshaft 45 extends through wall member 10 and a bearing assembly 52 supported by the wall member. This end of the crankshaft is provided outside the frame with a flywheel 54 which is interconnected with drive motor 40 by a suitable endless belt 56. Accordingly, rotation of the output shaft of motor 40 rotates flywheel 54 to rotate crankshaft 45 and thus crank members 42 and 44. The other end of crankshaft 45 extends through wall member 20 of the main frame and a suitable bearing assembly 58 supported thereby. This end of the crankshaft is provided with a pulley 60. Pulley 60 is connected through an endless belt 62 with a pulley fixed on the input shaft of a gear box 64. The gear box has an output shaft 66 to provide a power take-off which may be employed, for example, to operate the feed mechanism for introducing can blanks into the press.

Figure 3:
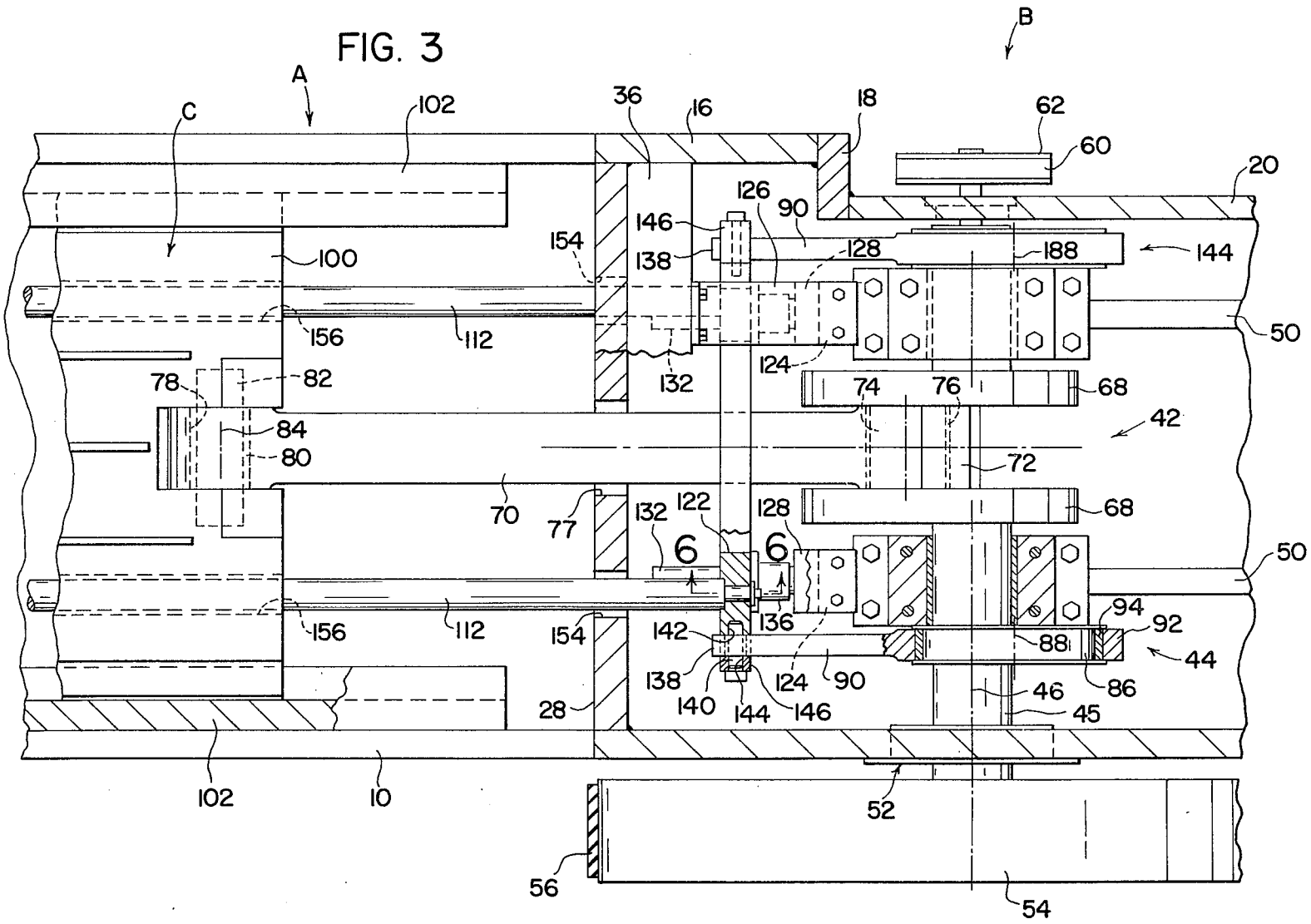
FIG. 3 is an enlarged plan view, partially in section, of the slide and blank holder frame drive arrangement taken along line 3—3 in FIG. 1.
Figure 4:
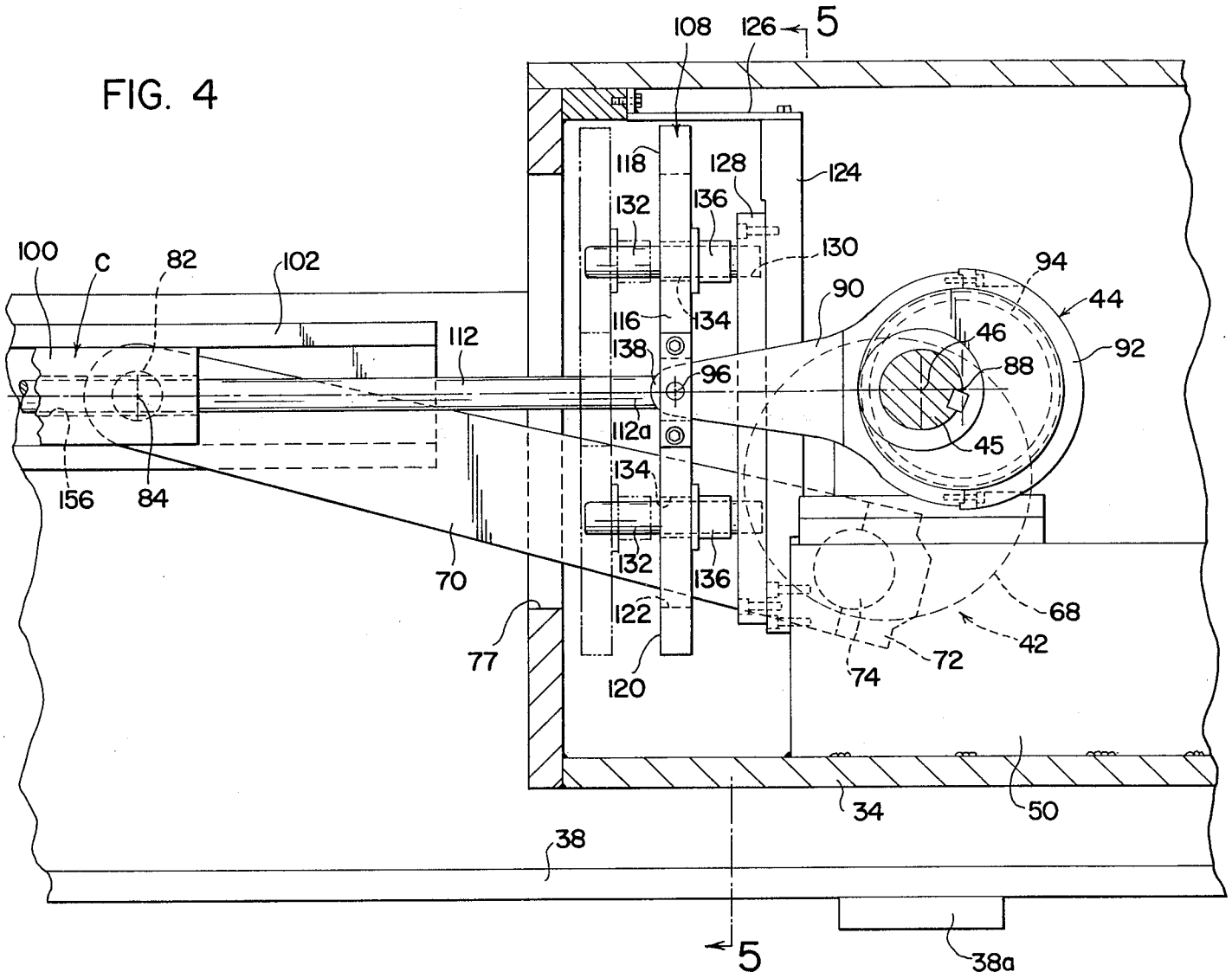
FIG. 4 is an enlarged side elevation view, partially in section, of the drive arrangement shown in FIG. 3.

As best seen in FIGS. 3 and 4, crank member 42 includes a pair of crank arms 68 pivotally interconnected with one end of a connecting rod 70. Any suitable interconnection between the crank arms and rod 70 can be provided. In the embodiment illustrated, the connecting rod end is recessed and provided with a recessed connection cap 72. The recessed rod end and cap cooperatively receive crank pin 74. A suitable bushing 76 is interposed between crank pin 74 and the connecting rod. The other end of connecting rod 70 is pivotally interconnected with the slide component of punch and slide assembly C. In this respect, as best seen in FIG. 4, the latter end of connecting rod 70 is provided with an aperture 78 lined with a suitable bushing 80 to receive a wrist pin 82 having its opposite ends suitably interconnected with the slide member.

It will be appreciated that rotaton of crank member 42 about crankshaft axis 46 imparts reciprocating movement to punch and slide assembly C relative to frame A and between first and second positions corresponding to the opposite ends of the throw of the crank member. Cross plate 28 of frame A is provided with a suitable window 77 through which connecting rod 70 extends. Further, pin 82 has a horizontal axis 84 about which the corresponding end of connecting rod 70 pivots during reciprocating movement of the punch and slide assembly, and pin axis 84 and crankshaft 46 lie in a common horizontal plane.

With further reference to FIGS. 3 and 4, it will be seen that each crank member 44 includes an eccentric 86 mounted on crankshaft 45 for rotation therewith. Eccentrics 86 have axes 88 parallel to and offset with respect to crankshaft axis 46 a distance corresponding to the stroke of the blank holder. Each eccentric 86 is pivotally interconnected with one end of a corresponding connecting rod 90. In the embodiment illustrated, the latter end of connecting rod 90 is recessed and provided with a recessed connection cap 92. The recessed rod end and cap cooperatively receive eccentric 86, and a suitable bushing 94 is interposed between each eccentric and connecting rod. The other ends of connecting rods 90 are pivotally interconnected with corresponding side portions of the blank holder and blank holder frame assembly D, as set forth more fully hereinafter. Accordingly, it will be appreciated that rotation of crank members 44 about axis 46 imparts reciprocating movement to the blank holder and blank holder frame assembly D relative to frame A, and between first and second positions corresponding to the throw of crank member 44. The pivotal connection between the ends of crank arms 90 and the blank holder and blank holder frame assembly D is about a horizontal axis 96 which is parallel to and coplanar with axes 46 and 84 defined hereinabove.

SLIDE AND PUNCH ASSEMBLY C

As will be seen from FIG. 2, the slide and punch assembly includes a slide member 100 supported for reciprocating movement relative to frame A by suitable guide and support assemblies 102 mounted on frame sides 10 and 16 between cross plates 26 and 28. In the embodiment shown, slide 100 carries a pair of punch members 104 having axes parallel to one another and horizontally coplanar with one another and with axes 46 and 84. Punch members 104 have outer ends which extend through cross plate 26 and are slideably supported for reciprocating movement relative thereto by corresponding bearing assemblies 106 mounted on the cross plates. The stroke of crank member 42 provides for punch members 104 to reciprocate along a linear path between a first or rearward position in which the ends of the punches are close to bearing assemblies 106 and a second or outermost position in which the ends of the punches are adjacent doming assemblies F of the machine. During this reciprocation the punches move through the corresponding blank holder members as described hereinafter and through the corresponding redraw and ironing assembly E to form a can blank which has been deposited at the entrance end of the redraw and ironing ring assembly. The particular structure of the slide and punch assembly and its slideable interengagement with frame A is not important to the present invention, and any suitable slide structure and slide supporting arrangement can be employed. One such slide and punch structure particularly suited for use with the can forming press disclosed herein is shown and described in co-pending U.S. patent application Ser. No. 458,392 filed Apr. 8, 1974, now U.S. Pat. 3,889,509, and assigned to the assignee of the present invention.

BLANK HOLDER AND BLANK HOLDER FRAME ASSEMBLY D

The structure of blank holder and blank holder frame assembly D is shown generally in FIG. 2 and in detail in FIGS. 3–7 of the drawings. Referring to these Figures, it will be seen that the assembly includes a blank holder frame comprising an upright frame plate member 108 adjacent the crankshaft of the press, a blank holder mounting plate 110 forwardly of main frame cross member 26, and a pair of laterally spaced apart parallel rods 112 interconnecting plate members 108 and 110 and defining the sides of the blank holder frame. Upright frame plate member 108 includes laterally spaced apart side portions 114 and 116 interconnected by vertically spaced apart top and bottom portions 118 and 120, respectively. The side, top and bottom portions together provide a rectangular opening 122 through which connecting rod 70 of crank member 42 extends. Accordingly, it will be appreciated that opening 122 is laterally and vertically dimensioned to receive the connecting rod and permit movement thereof without interference with frame plate member 108 in response to crank rotation.

Figure 5:
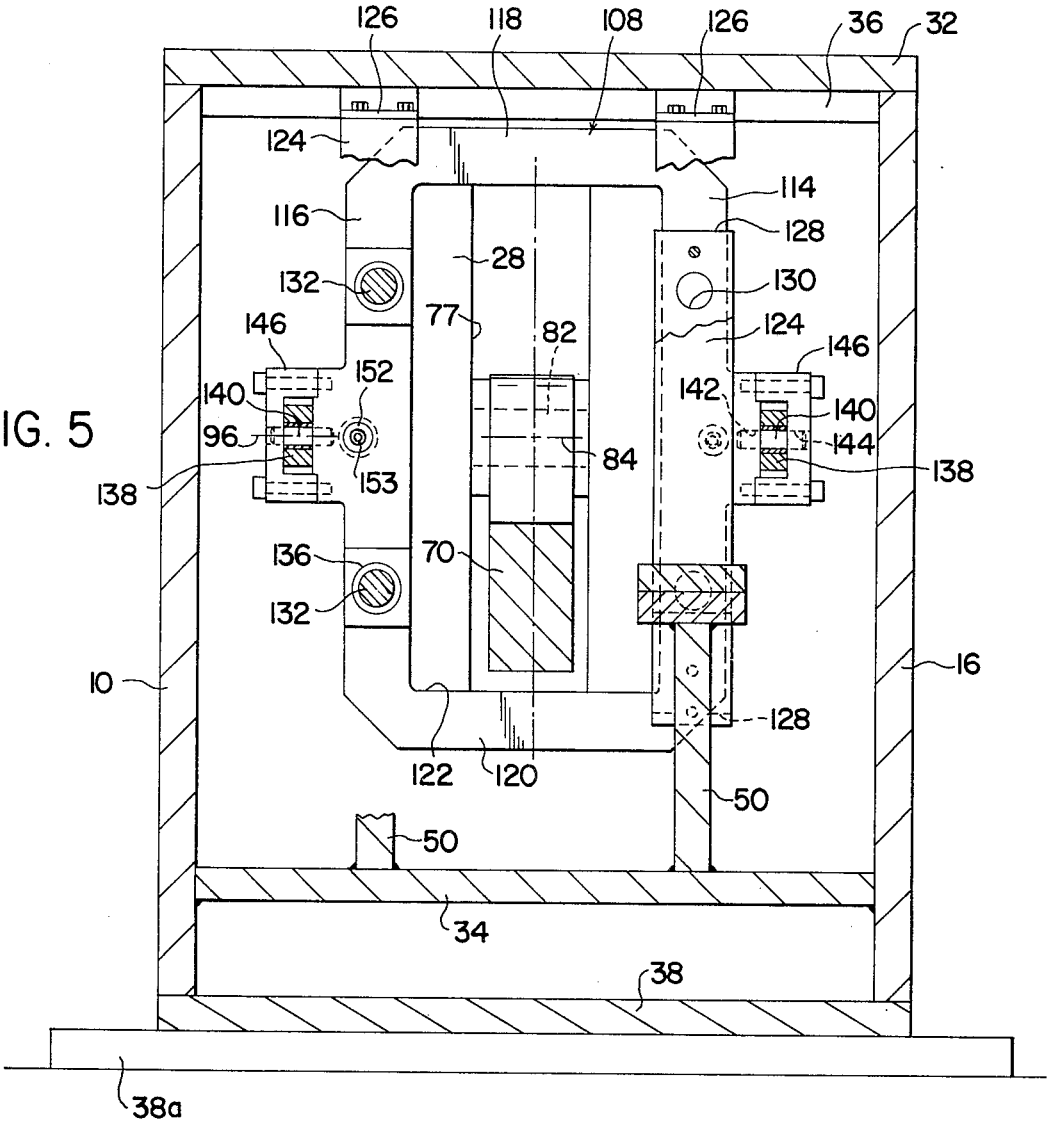
FIG. 5 is a sectional elevation view of the drive arrangement taken along line 5—5 in FIG. 4.
Figure 6:
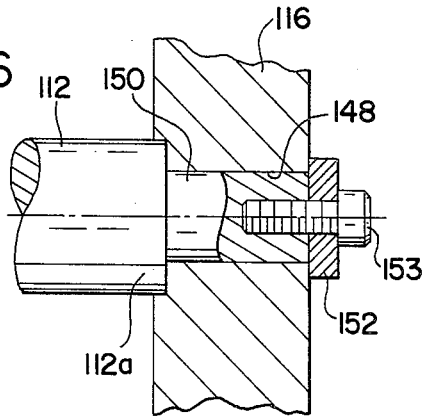
FIG. 6 is an enlarged detail view taken along line 6—6 in FIG. 3 and showing the joint connection between the rear frame plate and side rods of the blank holder frame.

Frame plate member 108 is supported for reciprocation in opposite directions relative to main frame A and perpendicular to the plane of the plate member. More particularly, as best seen in FIGS. 3–5, a pair of laterally spaced apart upright support members 124 are mounted on main frame A by bolting or otherwise securing the lower ends thereof to a corresponding one of the frame plates 50. The upper ends of members 124 are interconnected with frame A by corresponding brace members 126 having opposite ends bolted or otherwise interconnected one with frame plate 36 and the other with the upper end of the support member. Each upright support member 124 is provided with a guide pin mounting plate 128 which is bolted or otherwise secured to the corresponding member 124. Each guide pin mounting plate is provided with a paiir of vertically spaced apart apertures 130 receiving an end of a corresponding horizontally extending guide pin 132. The ends of the guide pins may be press fitted or otherwise interengaged with apertures 130 to securely mount the pins on the corresponding mounting plate.

The axes of the upper and lower pins 132 on each mounting plate 128 are vertically aligned, and the axes of the upper pair of pins are horizontally aligned as are the axes of the lower pair of pins. Moreover, the pin axes are symmetrical with respect to a horizontal plane through crankshaft axis 46 and slide pin axis 84, and with respect to a vertical plane longitudinally bisecting connecting rod 70 of crank member 42. Side portions 114 and 116 of blank holder frame plate member 108 are provided with apertures 134 for pins 132, and sleeve bearing members 136 are mounted on side portions 114 and 116 in coaxial alignment with apertures 134 to slideably receive a corresponding one of the guide pins 132. Accordingly, it will be appreciated that frame plate member 108 is horizontally reciprocable along guide pins 132 toward and away from guide pin mounting plates 128.

Blank holder frame plate member 108 is reciprocated by crank members 44 through connecting rods 90. More particularly, as best seen in FIGS. 4 and 5, each connecting rod 90 has an end 138 adjacent the outer side of a corresponding one of the side portions 114 and 116 of frame plate member 108. Connecting rod ends 138 are apertured to receive pivot pins 140 by which the connecting rod end is pivotally interconnected with the corresponding side portion. Each pin 140 has an inner end received in an aperture 142 provided in the corresponding side portion of plate member 108, and an outer end received in an aperture 144 provided in a cap member 146 which is bolted or otherwise secured to the corresponding side portion of member 108. Pins 140 are coaxial and the axes thereof are parallel to crank axis 46 and coplanar with the latter axis and slide pin axis 84. It will be appreciated from the foregoing description that rotation of crankshaft 45 imparts reciprocating movement to frame plate member 108 and that the latter member is supported and guided during such reciprocation by guide pins 132. During a complete cycle of rotation of crank members 44, frame plate member 108 is horizontally displaced between the solid line and broken line positions thereof shown in FIG. 4.

Rod members 112 defining the sides of the blank holder frame have corresponding ends **112*a* interconnected with side portions 114 and 116 of frame plate member 108 for reciprocating movement therewith. More particularly, as shown in detail in FIG. 6 with respect to side portion 116, the side portions of plate member 108 are provided with openings 148 therethrough, and ends 112*a* of rods 112 are provided with a reduced portion 150 extending through openings 148. The rod is interconnected with the side portion of plate member 108 against axial separation relative to opening 148 by means of a washer 152 and a bolt 153 extending through the washer and into threaded engagement with an aperture provided therefor in rod portion 150. Rod members 112 are cylindrical in cross section and are horizontally parallel with one another. Moreover, the axes of the rods are parallel and coplanar with respect to the axes of punches 104 and are coplanar with axes 96 between connecting rods 90 and frame plate member 108.**

Figure 8:
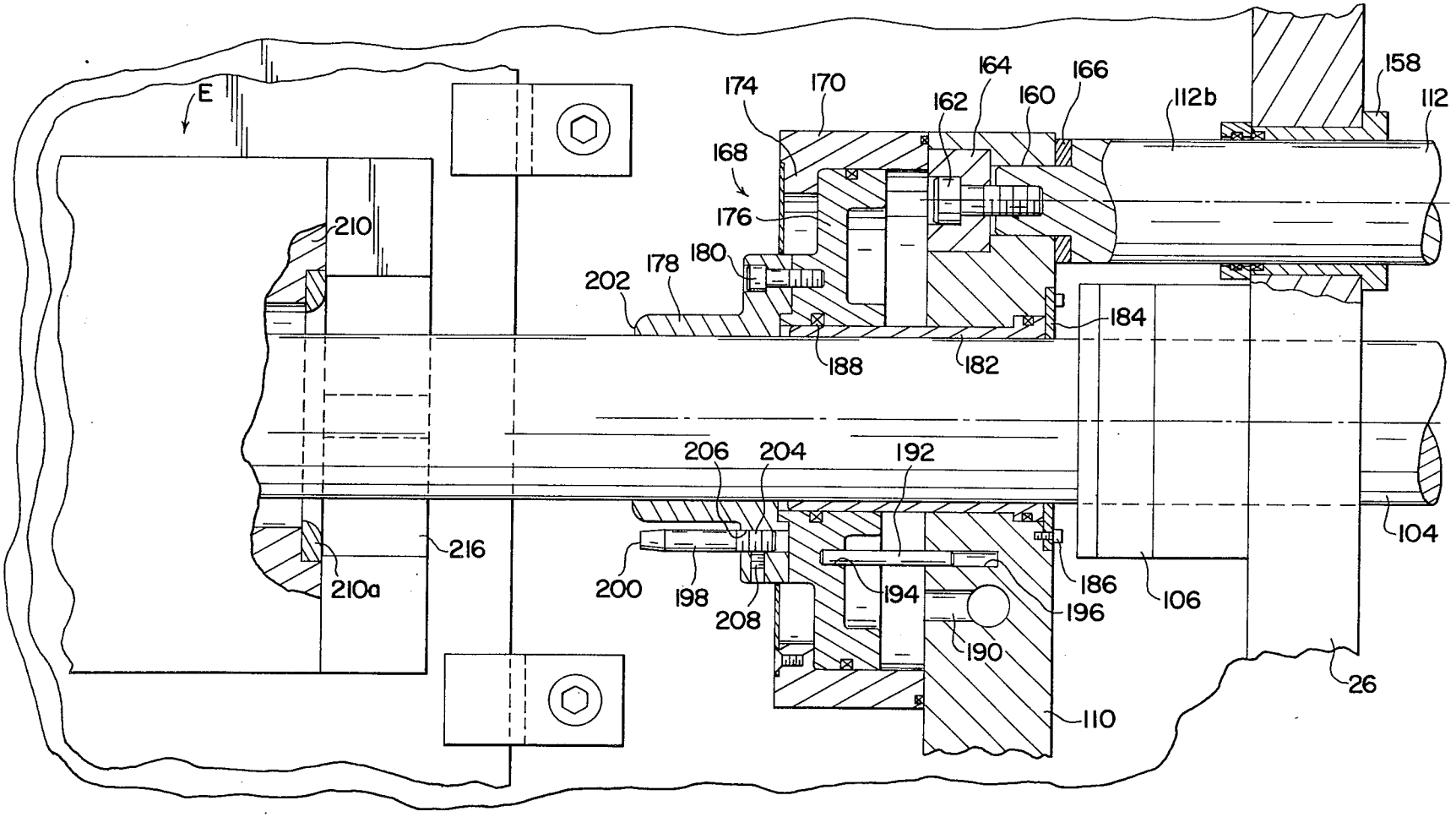
FIG. 8 is an enlarged plan view in section of a blank holder member, the section being along line 8—8 in FIG. 7.

Rods 112 extend forwardly from frame plate member 108, through suitable windows 154 provided thereofr in therefor frame plate 28 and thence through openings 156 provided therefor in slide member 100, as shown in FIG. 2. The forward ends of rods 112 extend through openings provided therefor in main frame plate 26, and the rods are attached forwardly of plate 26 to blank holder mounting plate 110. More particularly, as best seen in FIG. 8 showing one of the rod and blank holder mounting plate connections, main frame plate 26 is provided with a bearing sleeve assembly 158 receiving and slideably supporting the corresponding end of rod 112. End 112*b* of the rod is provided with a reduced diameter portion 160 received in an aperture provided therefor in blank holder mounting plate 110. The latter plate is in turn engaged with the rod end for reciprocating movement therewith by means of a threaded stud 162 extending through a mounting sleeve 164 and into a threaded aperture provided in the rod end. Preferably, a grind washer 166 is interposed between mounting plate 110 and the larger diameter portion of the rod end to assure proper alignment between the components.

Figure 7:
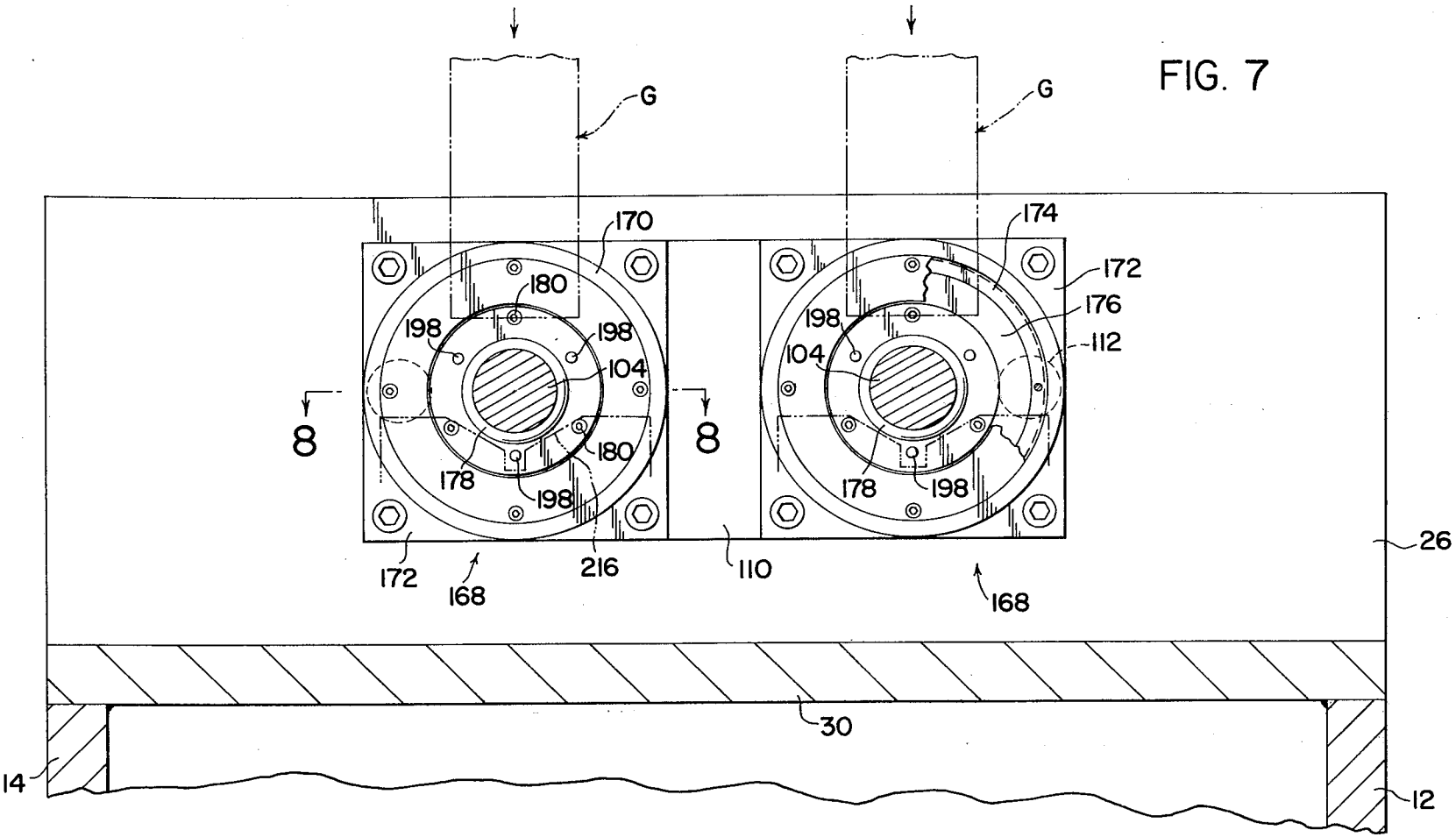
FIG. 7 is a sectional elevation view of the press taken along line 7—7 in FIG. 2 and showing the blank holder members.
Figure 9:
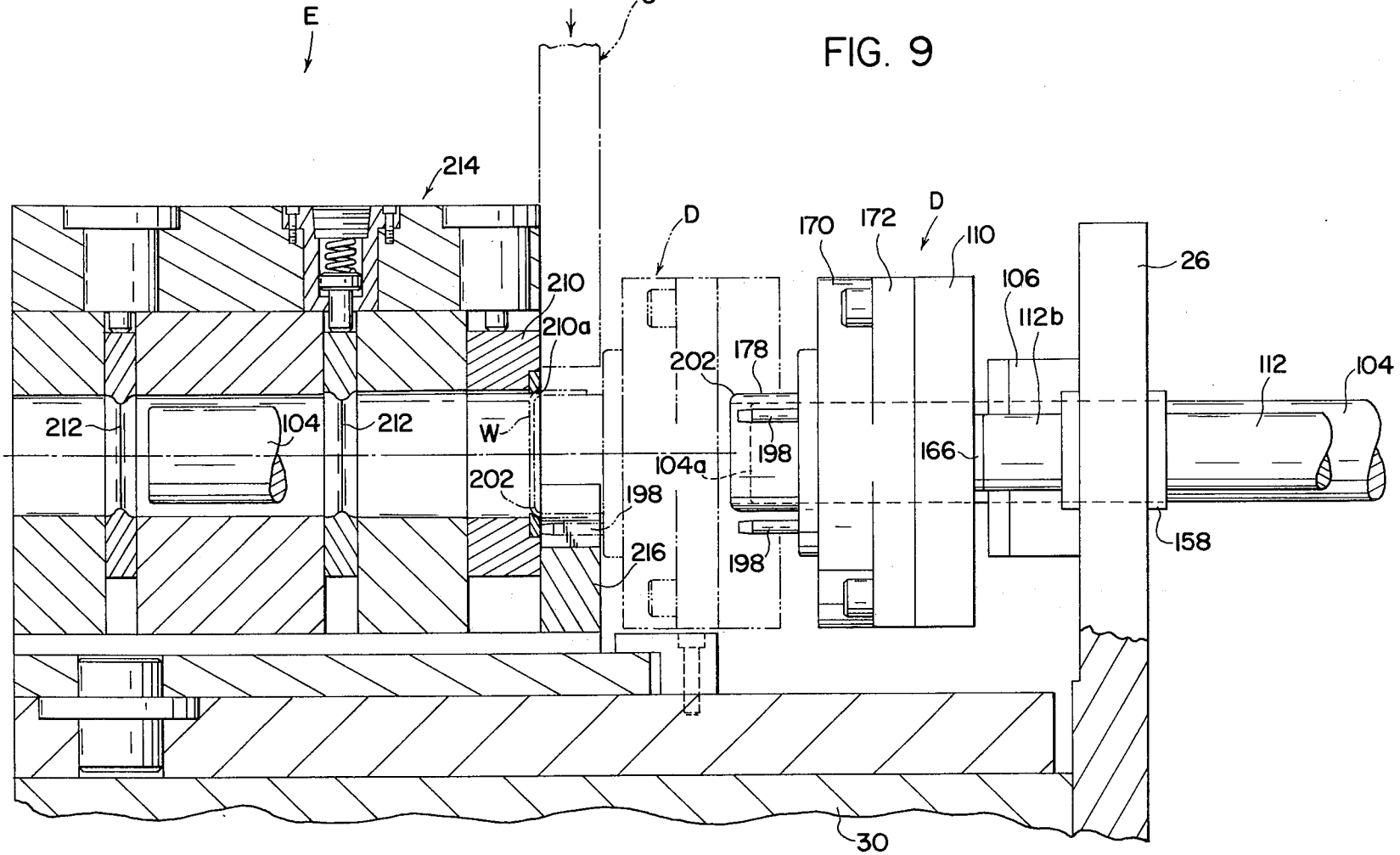
FIG. 9 is a side elevation view, partially in section, showing the positional relationships between a can blank, blank holder, redraw die ring and punch during machine operation; and, FIG. 10 is a graph showing the slide and blank holder stroke displacements for one complete revolution of the press drive shaft.

As seen in FIGS. 7–9, a pair of blank holder assemblies 168 are mounted on blank holder mounting plates 110, one for each of the punch members 104. Each blank holder assembly includes a housing component having an annular wall portion 170, radially outwardly extending mounting flanges 172 by which the housing is adapted to be bolted to mounting plate 110, and a radially inwardly extending flange 174 spaced forwardly of mounting plate 110 when the housing is mounted thereon. A reciprocable piston member 176 is disposed in the chamber defined by mounting plates 110 and housing 170, and an annular blank holder member 178 is attached to the outer face of piston 176 by means of a plurality of threaded studs 180. Blank holder support plate 110 is apertured to receive a bearing sleeve 182, and the bearing sleeve is attached to the mounting plate by means of an annular retaining plate 184 and threaded studs 186. Piston 176 has an axial bore providing for the piston to be slideably received and supported by bearing sleeve 182, and the piston bore is provided with a peripheral recess receiving a sealing ring 188 to seal the juncture between the piston and bearing sleeve against leakage therebetween for the purpose set forth hereinafter. Sleeve 182 slideably receives punch 104, and blank holder member 178 is also bored to slideably receive the punch member.

Blank holder mounting plate 110 is provided with a fluid passageway 190 which opens into the chamber behind piston 176 for the purpose of introducing fluid such as air into the chamber to bias piston 176 axially outwardly toward engagement with radial flange 174 of housing 170. It will be appreciated that passageway 190 is adapted to be connected to a suitable source of fluid, not illustrated. Further, piston 176 is provided with a plurality of guide pins 192 which are press fitted or otherwise secured in corresponding apertures 194 in the piston so as to extend rearwardly from the piston and into corresponding guide pin apertures 196 provided in mounting plate 110. Apertures 196 and pins 192 cooperate to guide reciprocating movement of piston 176 and to prevent rotation of the piston relative to housing 170.

Blank holder sleeve 178 is provided with a plurality of pins 198 having outer ends 200 which terminate adjacent the forwardmost peripheral edge 202 of the blank holder member. Pins 200 serve the purpose set forth hereinafter and, preferably, the pins are axially adjustable relative to the blank holder member. In the embodiment shown, such adjustment capability is achieved by providing each pin with a threaded end 204 received in a cooperatively threaded bore 206 in the blank holder member. A set screw 208 serves to releaseably hold the pin in a desired axial position against rotation relative to the blank holder member.

It will be appreciated from the foregoing description that blank holder members 178 have axes coinciding with the axes of punch members 104 and that the blank holder member axes are accordingly parallel to one another and coplanar with drive shaft axis 46, slide pin axis 84, the axes of side rods 112 of the blank holder frame, and the axes 96 defined by pins 140 on blank holder frame plate member 108. This coplanar relationship between the several axes provides a balanced relationship with regard to forces imposed on the relatively moving parts during machine operation. Thus, wear is minimized and uniformity in wear is achieved together with a reduction in heat and friction between the component parts. Further, the eccentric motion of the blank holder frame crank members 44 generates side thrust, and the guide pin arrangement for blank holder frame plate member 108 advantageously transmits the side thrust through the pins to the main frame. Accordingly, the effect of such side thrust on the blank holder and blank holder frame assembly is minimized.

It will be appreciated of course that the relative circumferential positions between crank arms 68 of crank member 42 and eccentrics 86 of crank members 44 provide the desired timing with respect to the relative displacements of the blank holder members and punches during each cycle of press operation. Moreover, the positive drive arrangement through the two crank assemblies not only enables such timing to be accurate but also to be constant with respect to succeeding strokes of the components. Still further, the crank drive and the use of a common crankshaft provides the rigidity necessary for the machine to operate with minimum vibration. All of these factors lend to high speed production, product uniformity, efficiency of operation and maintenance, and minimum can blank material wastage.

OPERATION

As will be seen in FIGS. 2 and 9, redraw and ironing ring assemblies E are supported by the main frame in axial alignment with the corresponding blank holder and punch members. Any suitable redraw and ironing ring structure can be employed, and in the embodiment disclosed each assembly E includes a redraw die ring 210 and one or more ironing rings 212 axially spaced from and aligned with redraw ring 210. The several die rings are suitably supported by a housing 214 such that redraw die ring 210 is adjacent the entrance end of the redraw and ironing ring assembly. A V-block 216 is disposed adjacent the outer face of redraw ring 210 to receive and support a can blank W delivered thereonto from blank feeder G. After a can blank is deposited on V-block 216, blank holder 178 moves toward assembly E and into the can blank as shown by the broken line position of assembly D in FIG. 9. Peripheral front edge 202 of the blank holder engages the bottom wall of blank W and advances the blank toward redraw die ring 210 and into a position adjacent the peripheral die surface 210*a* of the die ring. During this portion of movement of blank holder 178 toward assembly E, the forward end 104*a* of the corresponding punch 104 is disposed within the blank holder member and is spaced inwardly from peripheral edge 202 thereof. When blank holder 178 has axially positioned blank W relative to die surface 210*a*, pins 198 engage the outer face of redraw die ring 210 to stop further movement of the blank holder member toward the die ring. The engagement of of pins 198 with ring 210 substantially corresponds with the end of the blank holder stroke. Any movement of the blank holder frame toward assembly E following engagement of pins 198 with die ring 210 is relative to blank holder 178 and is cushioned by the air under pressure in the chamber defined by piston 176 and blank holder mounting plate 110.

When blank holder 178 has positioned blank W relative to die ring 210 as described above, the corresponding punch 104 advances axially through the blank holder and relative thereto to displace blank W from the blank holder and through redraw die ring 210. Continued advancement of the punch displaces the blank through the ironing rings 212 and into engagement with the corresponding doming assembly F to complete the can blank forming operation. Thereafter, punch 104 moves in the opposite direction together with blank holder 178 to reposition the components for the succeeding cycle of operation.

Figure 10:
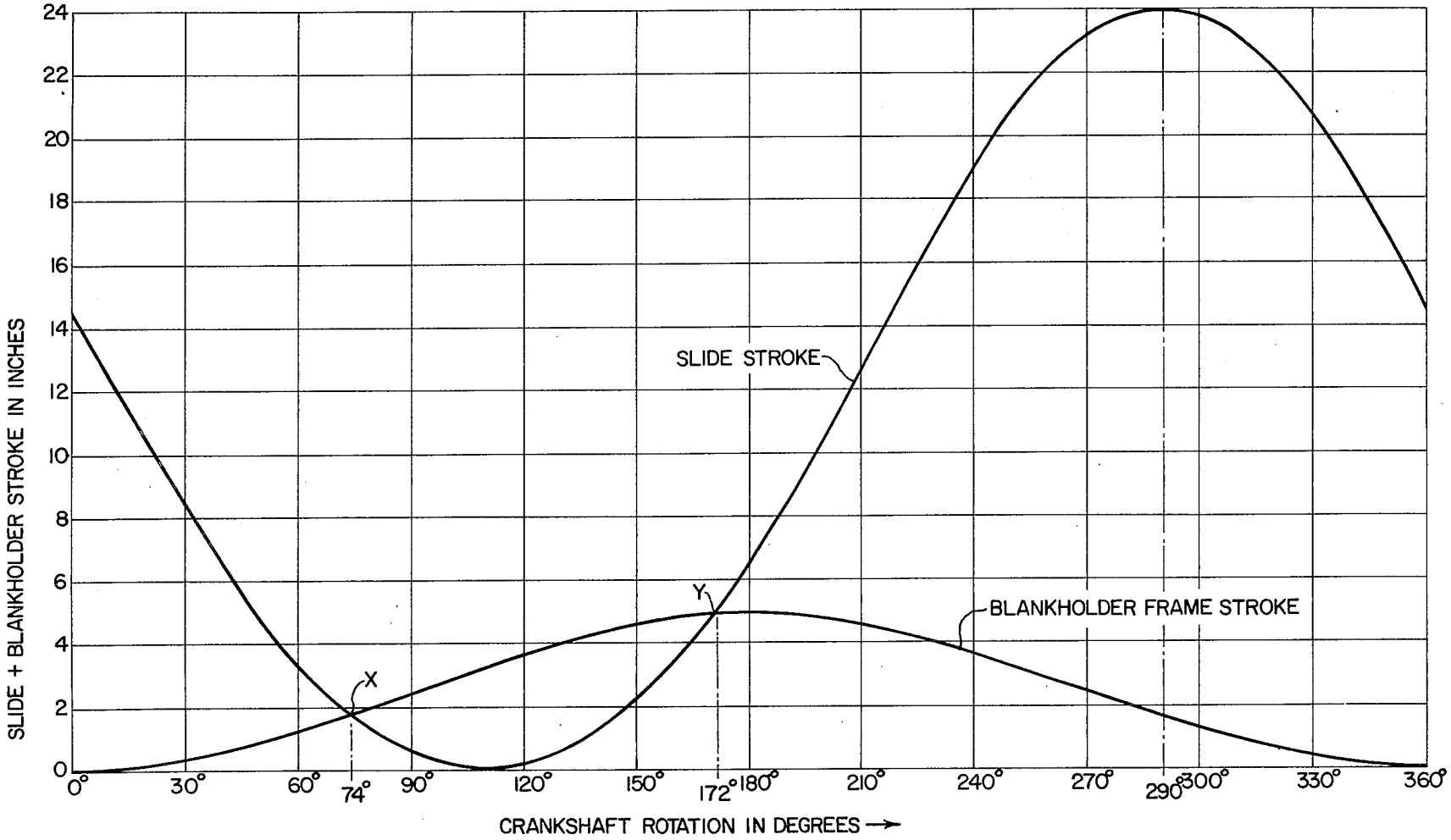

In the embodiment herein illustrated and described, punch 104 has a total stroke of 24 inches and blank holder 178 has a total stroke of 5 inches. The respective strokes are of course relative to one another and are repeated for each complete revolution of the machine crankshaft. The relative positions of the blank holder and punch during a complete revolution of the crankshaft is graphically illustrated in FIG. 10 with reference to the strokes of the slide and blank holder frame. In FIG. 10, the length of the respective strokes are measured from the rearwardmost position of the corresponding component relative to the redraw and ironing ring assembly. Further, the 0° reference point with regard to rotation of the crankshaft corresponds to the crankshaft position shown in FIG. 1 of the drawings. When the crankshaft is in the 0° position of rotational displacement, the blank holder frame and thus blank holder 178 are fully withdrawn relative to die assembly E, and the slide and thus punch 104 are positioned between 14 and 15 inches from the fully withdrawn position thereof. Crankshaft rotation is counterclockwise as viewed in FIG. 1.

With the foregoing positional relationship in mind, it will be seen from FIG. 10 that rotation of the crankshaft from the position shown in FIG. 1 initiates forward movement of the blank holder toward the redraw and ironing assembly E and rearward movement of the punch toward the retracted position thereof. At about 74° of crankshaft rotation the forwardmost ends of the punch and blank holder member positionally coincide as shown by the intersection of the displacement curves at point X in FIG. 10. At this point of coincidence, the punch is still moving rearwardly and the blank holder has been advanced about 2 inches. Thus, about 3 inches of axial space exists between the blank holder and redraw and ironing ring assembly E, and this space is clear to receive a can blank since the punch is now withdrawn into the blank holder. It will be appreciated of course that displacement of a blank into a position adjacent the entrance end of assembly E is coordinated with the punch and blank holder positions so that the blank is not introduced until such time as clearance therefor is provided by retraction of the punch.

At about 110° of crank rotation the punch member is fully retracted and the blank holder continues to move toward assembly E to receive and move the blank into the position shown by broken lines in FIG. 9. At about 172 of crankshaft rotation the punch has moved forwardly to the extent that the outermost ends of the blank holder member and punch coincide as designated by the intersection of the displacement curves at point Y in FIG. 10. At this time, the blank holder member has positioned the blank against the redraw die ring, whereby continued forward movement of the blank holder frame to the forwardmost point of the stroke thereof is relative to the blank holder member as described hereinabove. At the 172° point of crankshaft rotation the punch engages the workpiece and displaces the workpiece through the redraw die ring and the ironing die rings and thence toward doming assembly F until the punch reaches the forwardmost end of its stroke at about 290° of crankshaft rotation. Meanwhile, at about 180° of crankshaft rotation the blank holder begins to move rearwardly toward the retracted position thereof. After 360°of crankshaft rotation the punch and blank holder members are again in the positions thereof illustrated in FIG. 1.

While considerable emphasis has been placed herein on the specific structures and structural interrelationships between the components of the preferred embodiment of the present invention, it will be appreciated that many embodiments of the invention can be made and that many changes can be made in the embodiment herein illustrated and described without departing from the principles of the present invention. Accordingly, it is to be distinctly understood that the foregoing descriptive matter is to be interpreted merely as illustrative of the present invention and not as a limitation.

What is claimed is:

1. In a cup-shaped article forming machine including a main frame, a tubular blank holder having an axis, blank holder frame means carrying said blank holder and supported by said main frame for reciprocating movement along a linear path parallel to said axis and between first and second locations, a die ring supported by said main frame in axial alignment with said blank holder, said blank holder receiving a cup-shaped blank during movement of said frame means in the direction from said first location toward said second location and positioning said blank relative to said die ring when said frame means is in said second location, a punch member coaxial with said blank holder, a slide supporting said punch member for reciprocating movement relative to said main frame and including movement in said direction and through said blank holder to engage and carry said blank through said die ring, and drive means to reciprocate said blank holder frame means and said slide, the improvement comprising: said drive means including crank means supported by said main frame for rotation about a crank axis transverse to said linear path, and connecting rod means having opposite ends, one of said opposite ends being pivotally connected directly to said crank means at an axiis parallel to and spaced from said crank axis, and the other of said opposite ends being pivotally connected directly to said blank holder frame means, whereby rotation of said crank means reciprocates said blank holder frame means.

2. The improvement according to claim 1, wherein said crank axis and said blank holder axis are coplanar.

3. The improvement according to claim 2, wherein said other end of said connecting rod means is pivotally connected to said blank holder frame means at an axis parallel to and coplanar with said crank axis.

4. The improvement according to claim 1, wherein said drive means further includes second connecting rod means having opposite ends pivotally interconnected one with said crank means at an axis spaced from said crank axis and the other with said slide for rotation of said crank means to reciprocate said punch member.

5. The improvement according to claim 4, wherein said other end of said second connecting rod means is pivotally connected with said slide at an axis parallel to and coplanar with said crank axis.

6. The improvement according to claim 1, wherein said blank holder frame means includes a frame plate member disposed perpendicular to said blank holder axis, said other end of said connecting rod means being pivotally connected to said frame plate member, and interengaging guide means on said frame plate member and said main frame, said guide means guiding reciprocating movement of said frame plate member in said perpendicular disposition.

7. The improvement according to claim 6, wherein said guide means includes a plurality of pins on said main frame having axes parallel to one another and to said blank holder axis, and means on said frame plate member slideably receiving said pins.

8. The improvement according to claim 7, wherein said other end of said connecting rod means is pivotally connected to said frame plate member at an axis parallel to and coplanar with said crank axis, and said pin axes are symmetrical with respect to said plane and on opposite sides thereof.

9. The improvement according to claim 6, wherein said blank holder frame means includes a support plate member parallel to and spaced from said frame plate member, and rod means interconnecting said frame plate member and support plate member in spaced relationship, said blank holder being mounted on said support plate member, and said rod means being parallel to said axis of said blank holder.

10. The improvement according to claim 9, wherein said rod means includes a pair of rods having axes coplanar with said crank axis and said blank holder axis.

11. The improvement according to claim 10, wherein said other end of said connecting rod means is pivotally connected to said frame plate member at an axis coplanar with said rod, crank and blank holder axes.

12. The improvement according to claim 11, wherein said guide means includes a plurality of pins on said main frame having axes parallel to one another and to said blank holder axis, and pin receiving bearing means on said frame plate member.

13. The improvement according to claim 12, wherein said pins are in pairs disposed on opposite sides of the plane of said coplanar axes and symmetrical with respect thereto.

14. In a cup-shaped article forming machine including a main frame, a hollow cylindrical blank holder having an axis, blank holder frame means carrying said blank holder and supported by said main frame for reciprocating movement along a linear path parallel to said axis and between first and second locations, a die ring supported by said main frame in axial alignment with said blank holder, said blank holder receiving a cup-shaped blank during movement of said frame means in the direction from said first location toward said second location and positioning said blank relative to said die ring when said frame means is in said second location, a punch member coaxial with said blank holder, a slide supporting said punch member for reciprocating movement relative to said main frame and including movement in said direction and through said blank holder to engage and carry said blank through said die ring, and drive means to reciprocate said blank holder frame means and said slide, the improvement comprising: said blank holder frame means including end members spaced apart in the direction of said blank holder axis and interconnected by side members spaced apart in the direction laterally of said axis, said blank holder being mounted on one of said end members, the other of said end members having an opening therethrough, said blank holder frame means and said main frame including interengaging guide means guiding said reciprocating movement of said blank holder frame means, said slide being between said end members of said blank holder frame means, and said drive means including crank means supported by said main frame for rotation about a crank axis transverse to said blank holder axis, first connecting rod means extending through said opening in said other end member and having opposite ends pivotally interconnected one with said crank means at an axis parallel to and spaced from said crank axis and the other with said slide, and second connecting rod means having opposite ends pivotally interconnected one with said crank means and the other with said blank holder frame means.

15. The improvement according to claim 14, wherein said other end of said first connecting rod means is pivotally interconnected with said slide at a slide axis parallel to said crank axis, said slide, crank and blank holder axes being coplanar.

16. The improvement according to claim 15, wherein said side members of said blank holder frame means have longitudinal axes coplanar with said blank holder axis.

17. The improvement according to claim 15, wherein said other end of said second connecting rod means is pivotally interconnected with said other end member of said blank holder frame means at an axis parallel to said crank axis and coplanar with said blank holder axis.

18. The improvement according to claim 17, wherein said side members of said blank holder frame means are rods having longitudinal axes parallel to one another and coplanar with said blank holder axis.

19. The improvement according to claim 14, wherein said other end member of said blank holder frame means has laterally spaced apart side portions, said guide means including pins mounted on said main frame and bearing means on said side portions of said other end member slideably receiving said pins, said pins having axes parallel to said blank holder axis.

20. The improvement according to claim 19, wherein said side portions of said other end member have opposite ends and said side members of said blank holder frame means are each connected to one of said side portions generally centrally of said opposite ends thereof, said bearing means being on opposite sides of the corresponding side member connection.

21. The improvement according to claim 19, wherein said side members of said blank holder frame means are frame rods and said guide means further includes means on said main frame providing frame rod receiving openings slideably supporting said frame rods at the ends thereof adjacent said one end member.

22. The improvement according to claim 21, wherein said side portions of said other end member of said blank holder frame means have opposite ends and said frame rods are each connected to one of said side portions generally centrally of said opposite ends thereof, said bearing means including a pair of sleeve bearings on each side portion, and the sleeves of each pair being on opposite sides of the corresponding frame rod connection and equally spaced therefrom.

23. The improvement according to claim 21, wherein said frame rods have axes parallel to said blank holder axis and coplanar therewith and with said crank axis.

24. The improvement according to claim 23, wherein said second connecting rod means includes a pair of connecting rod members each having opposite ends, corresponding ones of said connecting rod member ends being pivotally connected to said crank means at an axis spaced from said crank axis, and the other ends of said connecting rod members each being pivotally connected to one of said side portions of said other end member of said blank holder frame means at an axis parallel to said crank axis and coplanar with said blank holder axis.

25. The improvement according to claim 24, wherein said other end of said first connecting rod means is pivotally interconnected with said slide at an axis parallel to said crank axis and coplanar with said blank holder axis.

26. The improvement according to claim 25, wherein said side portions of said other end member of said blank holder frame means have opposite ends and said frame rods are each connected to one of said side portions generally centrally of said opposite ends thereof, said bearing means including a pair of sleeve bearings on each side portion, and the sleeves of each pair being on opposite sides of the corresponding frame rod connection and equally spaced therefrom.

* * * * *